US005542143A

United States Patent [19]

Jem-Yuan

[11] Patent Number: 5,542,143

[45] Date of Patent: Aug. 6, 1996

[54] CIRCULARLY CLEANING SWAB STRUCTURE

[76] Inventor: Lin Jem-Yuan, No. 8, 13 Lin, San Wan Tsun, San Wan Hsiang, Miao Li Hsien, Taiwan

[21] Appl. No.: 364,815

[22] Filed: Dec. 27, 1994

[51] Int. Cl.[6] ..... A47L 13/144

[52] U.S. Cl. ..... 15/119.1; 15/99; 15/228; 401/208

[58] Field of Search ..... 15/99, 51, 119.2, 15/119.1, 228; 401/208, 218

[56] References Cited

U.S. PATENT DOCUMENTS

| | | | |
|---|---|---|---|
| 2,153,686 | 4/1939 | Deegan, Sr. | 15/99 |
| 3,047,894 | 8/1962 | Sprang | 15/99 |
| 3,945,078 | 3/1976 | Acquaro | 15/99 |
| 4,926,515 | 5/1990 | Lynn et al. | 15/99 |
| 5,203,047 | 4/1993 | Lynn | 15/99 |

*Primary Examiner*—Mark Spisich

[57] ABSTRACT

A circularly cleaning swab structure mainly composed of a grip stem, a casing and an annular water-absorbing member. The casing is connected at a lower end of the grip stem and has an upper cover secured on an upper opening of the casing by fasteners to define an interior close water-containing room. The water-absorbing member is disposed around outer periphery of the casing and formed with inner engaging teeth for engaging with corresponding teeth of a rotary wheel rotatably disposed on an outer lateral side of the casing. A top portion of the water-absorbing member is inserted within a clearance defined between the casing and the upper cover while a bottom portion of the water-absorbing member is located under a bottom of the casing for contacting the ground. A handle is disposed on an upper section of the grip stem for controlling the rotation of the wheel, whereby after swabbing the ground, the contaminated bottom portion of the water-absorbing member is one-way circularly driven into the interior of the casing to be soaked into a detergent or a liquid and squeezed.

6 Claims, 6 Drawing Sheets

CIRCULARLY CLEANING SWAB STRUCTURE

BACKGROUND OF THE INVENTION

The present invention relates to a novel swab structure which incorporates a de-watering mechanism for squeezing a circulating water-absorbing member of the swab structure. The swab structure is composed of simple components and manufactured at reduced labor, cost and possibility of defect while achieving a desired cleaning effect.

A conventional swab includes a water-absorbing portion composed of fabric strips, fluff bundles, sponge block, etc. for achieving a water-absorbing/cleaning effect.

At early time, the fabric strips or fluff bundles of the conventional swab are dried manually by way of twisting. Subsequently, various types of squeezers, twisters and other de-watering devices are progressively developed to remove the contaminated water contained in the water-absorbing portion of the swab for further swabbing/cleaning work. By means of such de-watering device, the swabbing work can be more quickly completed while saving great labor. Moreover, a user's hands are prevented from contacting the contaminated swab and water, so that the possibility of bacteria infection of the user is reduced. This is a great advantage, especially to a sensitive user. However, the above de-watering devices inevitably occupy a considerably large space for storage and the costs for these de-watering devices are relatively high. Therefore, it has been attempted to develop a swab structure which incorporates a de-watering device for reducing the occupied room. Several examples of such swab structure are squeezing roller swab, spirally rotating swab, squeezing sleeve swab, sponge-clamping spring swab, etc. In all these swabs, the water-absorbing component and contaminated water-squeezing component are integrally associated as a unit and the occupied room is effectively reduced. However, such swab structures fail to provide a circularly cleaning function and therefore the swabbing procedure must be repeatedly performed several times for achieving a completely cleaning effect.

Several types of swab structure with circularly cleaning function are disclosed respectively in U.S. Pat. Nos. 1179427, 1364516, 3047894, 3945078 and 5203047. In general, such swab structure includes a circulated fabric or unwoven fabric component for wiping a floor, a water container and several rollers and gears, wherein the fabric or unwoven fabric component is spread into a plane sheet for wiping the floor. After the wiping procedure, the contaminated portion of the fabric is displaced into the water container in which a compressing mechanism disposed above the roller squeezes the contaminated fabric so as to remove the contaminated water therefrom. A motor is used to circulate the fabric for continuously cleaning the fabric of the swab structure. According to the above referenced Patents, all the swab structures have large volume and numerous elements, so that the assembly of these elements is complicated and the manufacturing cost therefor is relatively high. Thereby, such swab structures cannot be widely used by general consumers and are only adapted to be used for cleaning those places with relatively large area. Besides, in such swab structures, many sophisticated gears, ratchets and rollers for controlling the displacement of the fabric or unwoven fabric are required. This further increases the manufacturing cost with respect to working time, parts and labor. Therefore, while achieving some improvements and advantages, the above Patents all fail to be popular and commercially competitive.

SUMMARY OF THE INVENTION

It is therefore a primary object of the present invention to provide a swab structure mainly including a grip stem, a casing and an annular water-absorbing member. The casing is connected at a lower end of the grip stem and has an upper cover secured on the casing by fasteners to define an interior close water-containing room. The water-absorbing member is disposed around the outer periphery of the casing and formed with inner engaging teeth for engaging with corresponding teeth of a rotary wheel rotatably disposed on an outer lateral side of the casing. A top portion of the water-absorbing member is inserted within a clearance defined between the casing and the upper cover while a bottom portion of the water-absorbing member is located under a bottom of the casing for contacting the ground. A handle is disposed on an upper section of the grip stem for controlling the rotation of the wheel, whereby after swabbing the ground, the contaminated bottom portion of the water-absorbing member is one-way circularly driven into the interior of the casing to be soaked into a detergent or a liquid and squeezed.

It is a further object of the present invention to provide the above swab structure in which the upper cover of the casing is formed with a water inlet through which a detergent liquid can be filled into the water-containing room of the casing. The casing is formed with a draining hole on the bottom for draining unnecessary liquid.

It is still a further object of the present invention to provide the above swab structure which has less components and can be assembled very quickly and easily at low cost. Therefore, as a whole the manufacturing cost for the swab structure is considerably reduced and thus the swab structure is highly commercially competitive.

The present invention can be best understood through the following description and accompanying drawing, wherein:

DETAILED DESCRIPTION OF THE PREFERRED EMBODIMENT

Figure 1:
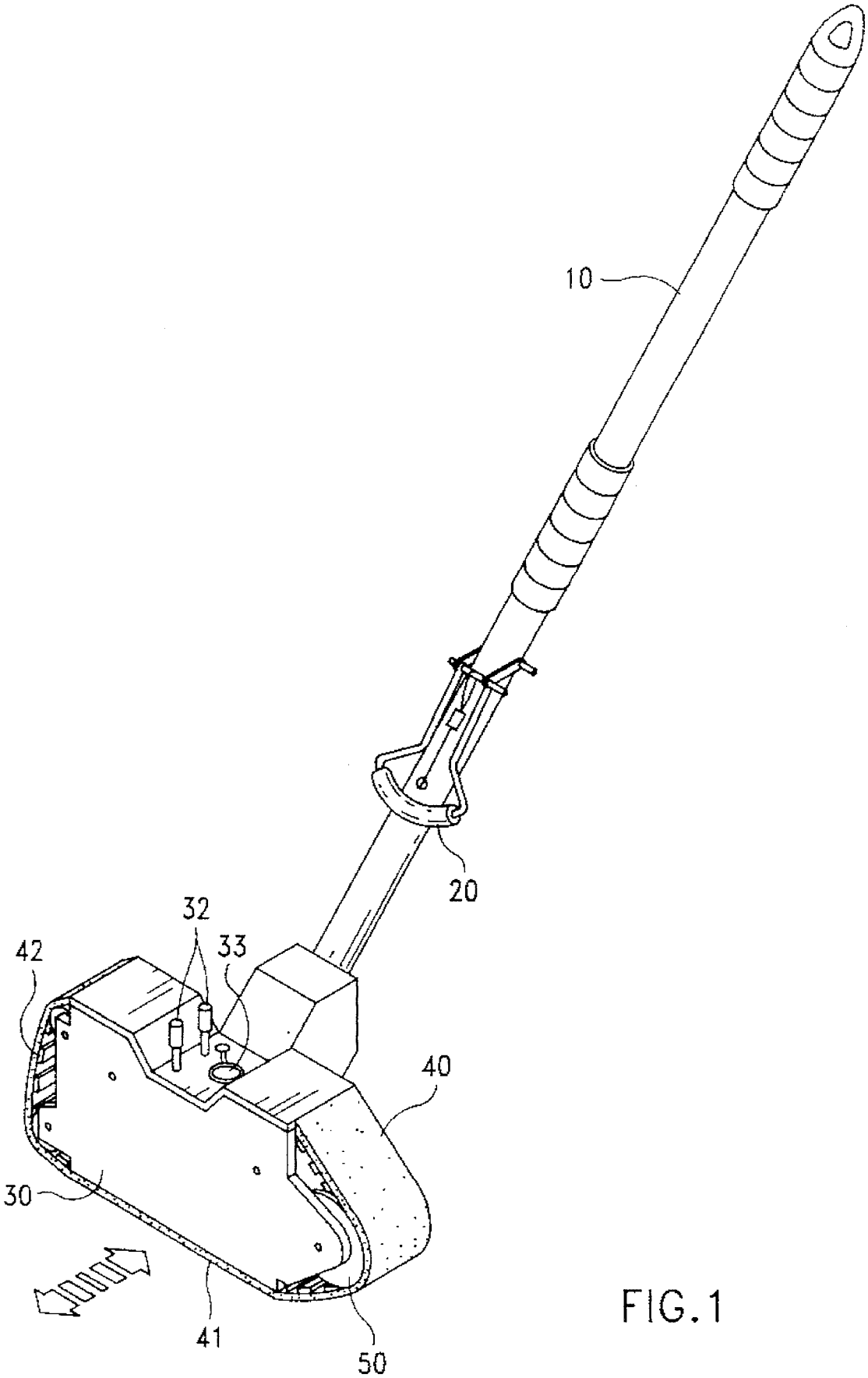
FIG. 1 is a perspective assembled view of the swab structure of the present invention.

Please refer to FIG. 1. The swab structure of the present invention mainly includes a grip stem 10, a casing 30 connected with the grip stem 10 in front of a lower end thereof and an annular water-absorbing member 40 surrounding the casing 30. The casing 30 is substantially rectangular, having an upper cover 31 fixed on the casing 30 by conventional juts (not shown) to define a close interior of the casing 30 and pulled by two sticks 32 to open the upper cover 31. The upper cover 31 is formed with a water inlet 33 for filling clean water into the casing 30. The water-absorbing member 40 is disposed with engaging teeth 42 on inner periphery for engaging with corresponding teeth 51 of a rotary wheel 50 rotatably disposed on an outer lateral side of the casing 30. A top portion of the water-absorbing member 40 is inserted within a clearance defined between the casing 30 and the upper cover 31 while a bottom portion 41 of the water-absorbing member 40 is located under a bottom of the casing 30 for contacting the ground. A handle 20 is disposed on an upper section of the grip stem 10 for controlling the rotation of the wheel 50, whereby after swabbing the ground, the contaminated bottom portion 41 of the water-absorbing member 40 is one-way circularly driven into the interior of the casing 30 to be soaked into a detergent or a liquid and squeezed dry.

Figure 2:
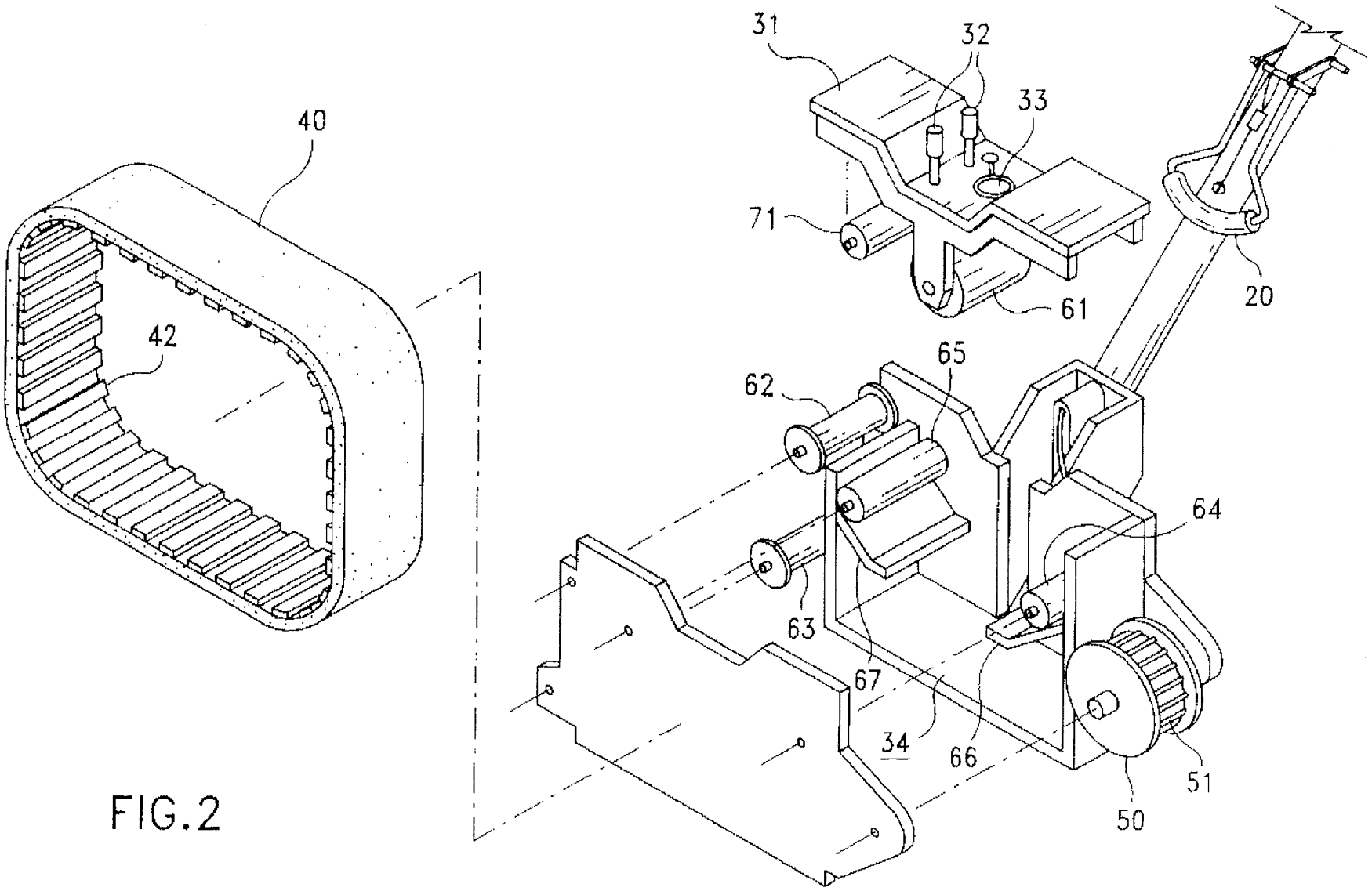
FIG. 2 is a perspective exploded view of the swab structure of the present invention.
Figure 6:
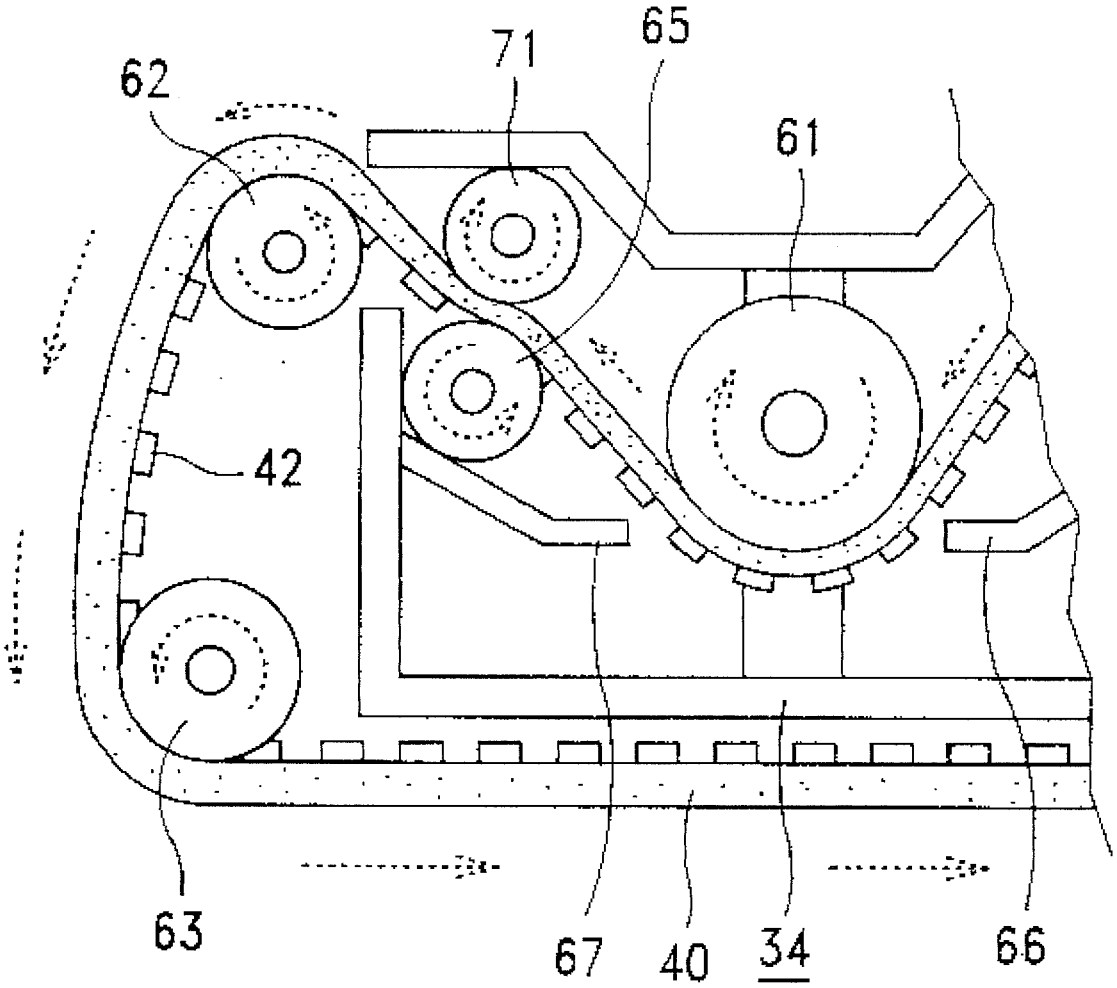
FIG. 6 is a partial side view in section of FIG. 1, showing the relationship about the location of rollors.

Please refer to FIG. 2 and 6. The casing 30 has an inner water sink 34 for containing the detergent or liquid filled into the casing 30 through the water inlet 33 of the upper cover 31. On two lateral walls of the water sink 34 are respectively disposed two guide boards 66, 67 which inwardly downward extend from upper sections of the lateral walls. Two rollers 64, 65 are respectively disposed on upper sections of the guide boards 66, 67. An upper and a lower rollers 62, 63 are located on an outer lateral side of the casing 30 opposite to the rotary wheel 50, whereby the water-absorbing member 40 is disposed around an outer periphery of the casing 30 and the rollers 62, 63 as well as the wheel 50. The upper cover 31 has a compressing roller 61 located thereunder and a squeezing roller 71 located above the roller 65, whereby when the upper cover 31 is associated with the casing 30, the squeezing roller 71 is close to the roller 65 and the compressing roller 61 is located between the roller 64 and the roller 65, the water-absorbing member 40 is clamped between the roller 64, compressing roller 61 and the roller 65 and squeezed by the squeezing roller 71 and the roller 65 so as to remove the contaminated water from the water-absorbing member 40. In addition, when the handle 20 of the grip stem 10 is pulled upward several times, the rotary wheel 50 is driven to make the water-absorbing member 40 circulate around the outer periphery of the casing 30.

Figure 3:
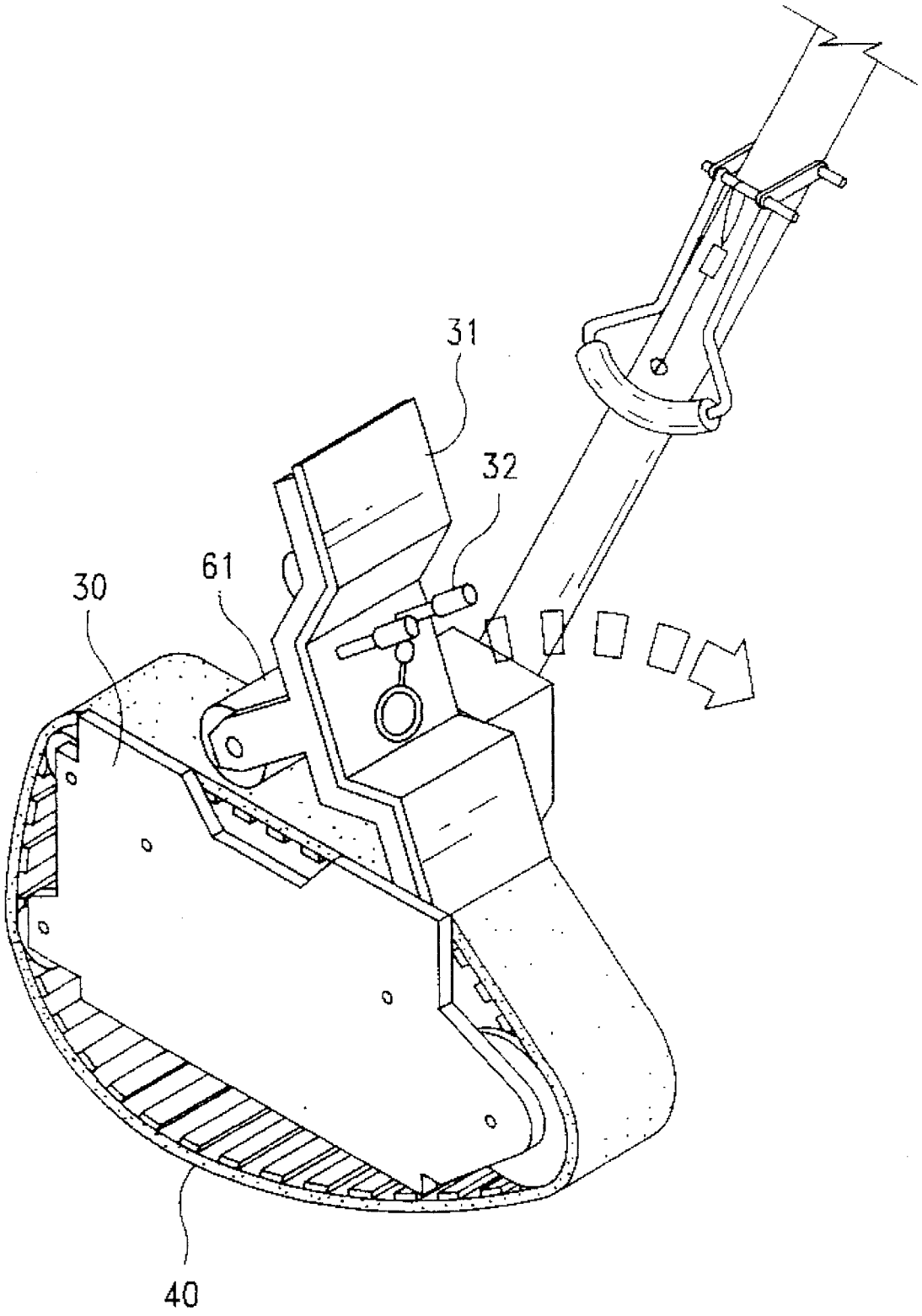
FIG. 3 is a front perspective view, showing that the upper cover of the casing is opened.
Figure 4:
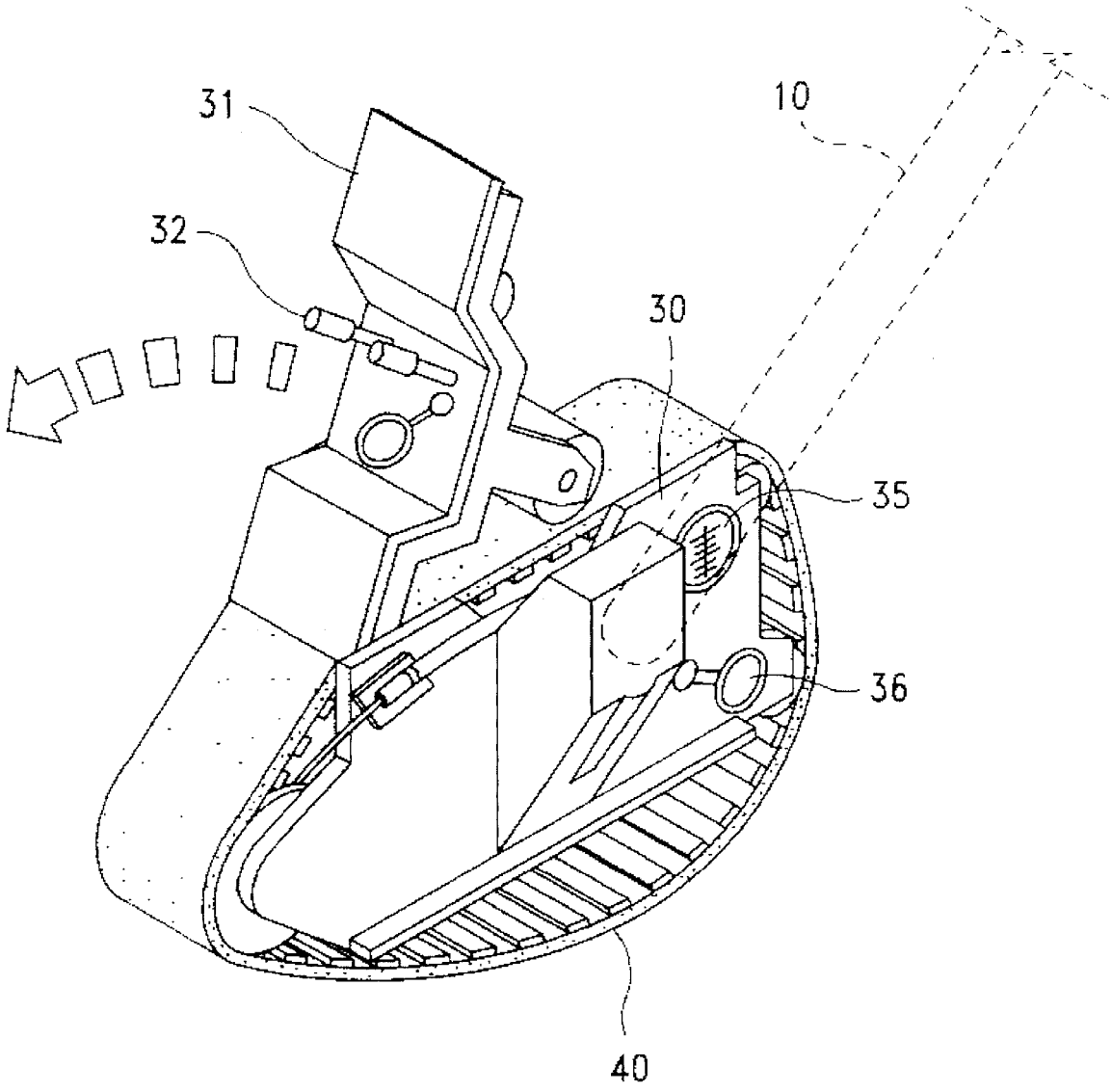
FIG. 4 is a rear perspective view according to FIG. 3.

Please now refer to FIGS. 3 and 4. When it is desired to clean up or dry up the interior of the casing 30 (such as the water sink 34), a user only needs to slightly pull the sticks 32, whereby the water-absorbing member 40 will via its own resilient force abut against the compressing roller 61 of the upper cover 31 and bound up and open the same. At this time, the water-absorbing member 40 is also prevented from failure of resilience due to long term of squeezing. In addition, an observation window 35 and a draining hole 36 are disposed on a rear wall of the casing 30 for the user to observe the level of the liquid contained in the water sink 34 and drain the unnecessary liquid.

Figure 5:
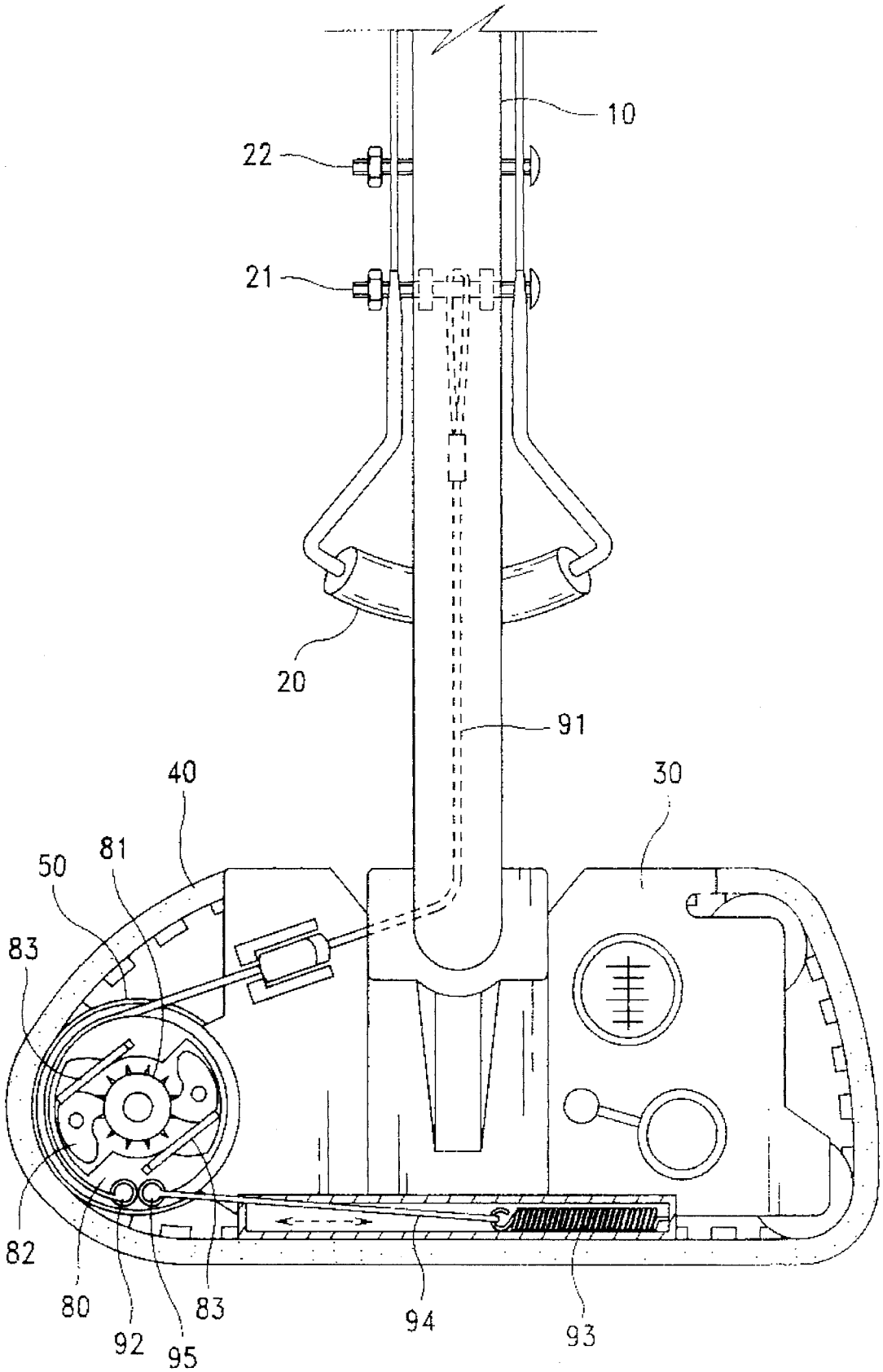
FIG. 5 shows the mechanism for circulating the water-absorbing member and the operation thereof.

Referring to FIG. 5, the handle 20 includes a pin member 21 fitted with a pull cord 91 which extends through an interior of the grip stem 10 to connect with the rotary wheel 50, and a handle shaft 22 serving as a fulcrum of the upward pulling motion of the handle 20, whereby when the handle 20 is pivoted upward, the pull cord 91 is pulled upward to rotatably drive the rotary wheel 50. A transmission wheel 80 is coaxially disposed beside the rotary wheel 50. A resilient plate 82 and a leaf spring 83 are disposed on the transmission wheel 80 and engaged with each other to abut against a ratchet wheel 81 integrally associated with the rotary wheel 50. A first and a second fixing blocks 92, 95 are secured on the transmission wheel 80, wherein the first fixing block 92 is connected with a lower end of the pull cord 91, while the second fixing block 95 is located adjacent to the first fixing block 92 and connected with a restoring cord 94 and one end of an extension spring 93 in series. The other end of the extension spring 93 is fixedly connected to a rear lower portion of the casing 30. According to the above arrangements, when the handle 20 is pivoted upward to pull up the pull cord 91, the transmission wheel 80 engaging with the first fixing block 92 and the lower end of the pull cord 91 is rotarily driven. As a result, the extension spring 93 engaged with the second fixing block 95 of the transmission wheel 80 is extended. At this time, the resilient plate 82 and leaf spring 83 such abut against the ratchet wheel 81 that the rotary wheel 50 along with the water-absorbing member 40 engaging with and surrounding the rotary wheel 50 is rotarily driven. Thereafter, when the handle 20 is released and returns to its home position, the extension spring 93 through the restoring cord 94 pulls the transmission wheel 80 back to its home position. However, by means of the resilience of the leaf spring 83 and the arch shape of the resilient plate 82, the resilient plate 82 will slip over the ratchet wheel 81 so that the ratchet wheel 81 as well as the rotary wheel 50 will not rotate when the transmission wheel 80 returns to its home position. Therefore, the rotary wheel 50 will rotate only in one direction. Accordingly, the handle 20 is used to pull the pull cord 91, making the rotary wheel 50 drive the water-absorbing member 40 into the water sink 34 of the casing 30. The water-absorbing member 40 is then squeezed and de-watered by the, squeezing roller 71 and the roller 65 to achieve the circularly cleaning effect.

It is to be understood that the above description and drawings are only used for illustrating one embodiment of the present invention, not intended to limit the scope thereof. Any variation and derivation from the above description and drawings should be included in the scope of the present invention.

What is claimed is:

1. A circularly cleaning swab structure comprising:

a substantially rectangular casing having an upper cover disposed on an upper opening of said casing to define a closed interior water sink for containing a cleaning liquid, a rotary wheel disposed with engaging teeth on its outer periphery being disposed on an outer lateral side of said casing and an upper roller together with a lower roller being disposed on another outer lateral side of said casing opposite to said rotary wheel, on two lateral walls of said water sink being respectively disposed two guide boards which extend from said lateral walls, a first roller and a second roller being respectively disposed on upper sections of said guide boards, said upper cover having a compressing roller and a squeezing roller located under said upper cover, said squeezing roller being just above said first roller;

a grip stem a lower end of which is connected with said casing, a handle being disposed on said grip stem and connected with a pull cord which extends through an interior of said grip stem to connect with said rotary wheel for rotatably driving the same;

an annular water-absorbing member disposed with engaging teeth on its inner periphery for engaging with corresponding engaging teeth of said rotary wheel, said water-absorbing member being disposed around said rotary wheel, said upper and lower rollers disposed on the outer lateral side of said casing and said rollers disposed on said guide boards, whereby a portion of said water-absorbing member is compressed and squeezed by said squeezing roller, said first roller, said second roller and compressing roller of said upper cover and soaked in the cleaning liquid contained in said water sink of said casing and whereby when said handle is pivoted upward, said rotary wheel is pulled and rotated to make said water-absorbing member circulate around said casing in one direction.

2. A swab structure as claimed in claim 1, wherein said engaging teeth of said rotary wheel are engaged with said engaging teeth of said water-absorbing member so as to drive the same to circulate around said casing.

3. A swab structure as claimed in claim 1, wherein said upper cover is formed with a water inlet through which the cleaning liquid is filled into said water sink of said casing.

4. A swab structure as claimed in claim 1, wherein an observation window is disposed on a rear Side of said casing for observing the level of the cleaning liquid contained in said water sink.

5. A swab structure as claimed in claim 1, wherein a draining hole is disposed on a rear bottom side of said casing for draining the liquid.

6. A swab structure as claimed in claim 2, wherein a ratchet wheel is coaxially fixedly connected with said rotary wheel and a transmission wheel is coaxially irreversibly connected with said ratchet wheel, a first and a second fixing block being secured on said transmission wheel, wherein said first fixing block is connected with a lower end of said pull cord, while said second fixing block is adjacent to said first fixing block and connected with a restoring cord and an extension spring in series, a resilient plate and a leaf spring being disposed on said transmission wheel to abut against said ratchet wheel such that when said handle is pivoted upward and released, said transmission wheel is rotatably driven to rotate said ratchet wheel and said rotary wheel in said one direction.

* * * * *